US005737854A

United States Patent [19]

Sussmann

[11] Patent Number: 5,737,854

[45] Date of Patent: Apr. 14, 1998

[54] SHOE WITH A CENTRAL CLOSURE

[75] Inventor: Reinhold Sussmann, Scheinfeld, Germany

[73] Assignee: Puma AG Rudolf Dassler Sport, Herzogenaurach, Germany

[21] Appl. No.: 113,661

[22] Filed: Aug. 31, 1993

[30] Foreign Application Priority Data

Aug. 31, 1992 [DE] Germany ..... 9211710 U

[51] Int. Cl.[6] ..... A43C 11/20; A43B 23/00

[52] U.S. Cl. ..... 36/50.1; 36/45; 36/107; 36/54

[58] Field of Search ..... 36/50.1, 45, 107, 36/89, 91, 92

[56] References Cited

U.S. PATENT DOCUMENTS

| | | | |
|---|---|---|---|
| 1,258,629 | 9/1918 | Bliss | 36/45 |
| 1,296,529 | 9/1919 | Koester | 36/50.1 |
| 2,591,211 | 4/1952 | Spencer | 36/58.5 X |
| 3,768,182 | 10/1973 | Powers | 36/114 |
| 4,222,183 | 9/1980 | Haddox | 36/45 X |
| 4,342,161 | 8/1982 | Schmohl | 36/50.1 X |
| 4,413,431 | 11/1983 | Cavanagh | 36/45 X |
| 4,670,998 | 6/1987 | Pasternak | 36/89 X |
| 4,726,126 | 2/1988 | Bernhard . | |
| 4,727,660 | 3/1988 | Bernhard . | |
| 4,811,500 | 3/1989 | Maccano | 36/91 |
| 4,858,339 | 8/1989 | Hayafuchi et al. | 36/45 |
| 5,117,567 | 6/1992 | Berger | 36/50.1 |
| 5,177,882 | 1/1993 | Berger . | |

FOREIGN PATENT DOCUMENTS

| | | | |
|---|---|---|---|
| 0122767 | 10/1984 | European Pat. Off. | 36/50.1 |
| 70308326 | 8/1969 | Germany . | |
| 89138066 | 11/1981 | Germany . | |
| 3932023 | 4/1991 | Germany | 36/50.1 |

*Primary Examiner*—Ted Kavanaugh
*Attorney, Agent, or Firm*—Sixbey, Friedman, Leedom & Ferguson; David S. Safran

[57] ABSTRACT

A shoe with a central closure attached to an instep cover, to which a wire-like tightening element is coupled and from which the tightening element runs back and forth between guide elements on side parts of the shoe upper and guide elements on the instep cover along the throat area of the shoe, where the guide elements on both sides of the shoe are connected, via a tensioning strip, with at least a pair of instep supporting straps which run over the side parts of the shoe upper from at least an edge area of the sole is improved by combining the instep supporting straps and the tensioning strips into a structural unit for each side of the shoe. Furthermore, the thickness of the instep supporting straps and the tensioning strips and/or the material properties of these parts is/are selected so that the tensioning strips have a greater stiffness than the supporting straps, and the tensioning strips, at least in the area of the guide elements is formed of a material that is abrasion-resistant, hard and has good sliding properties, i.e., a low coefficient of friction.

19 Claims, 2 Drawing Sheets

SHOE WITH A CENTRAL CLOSURE

BACKGROUND OF THE INVENTION

This invention relates to a shoe with a central closure attached to an instep cover, to which a rope-like tightening element is coupled and from which the tightening element runs back and forth between guide elements on side parts of the shoe upper and guide elements on the instep cover along the throat area of the shoe. More specifically, the invention is directed to such a shoe where guide elements on both sides of the shoe are connected, via a tensioning strip, with at least a pair of instep supporting straps which run over the side parts of the shoe upper from at least an edge area of the sole, one of which is directed toward an area at or behind the metatarsophalangeal joints and the other of which extends rearward toward the heel of shoe.

A shoe of this type is known from U.S. Pat. No. 5,177,882. In this shoe, tensioning strips are attached to the shoe upper and the instep supporting straps are run over the side pans of the shoe upper material, from a point of attachment between the sole and the upper material, to the tensioning strips. On their upper ends, the straps have locking elements which engage in slot-like openings of the tensioning strips, where they lock with counterlocking elements. This arrangement and configuration of the instep supporting straps and tensioning strips has proven itself well in shoes with a central closure attached in the instep area.

SUMMARY OF THE INVENTION

A primary object of this invention is to produce a shoe of the above-mentioned type more efficiently and economically.

This object and others are achieved by combining the instep supporting straps and the tensioning strips into a structural unit for each side of the shoe. Furthermore, the thickness of the instep supporting straps and the tensioning strips and/or the material properties of these parts is/are selected so that the tensioning strips have a greater stiffness than the supporting straps, and the tensioning strips, at least in the area of the guide elements is formed of a material that is abrasion-resistant, hard and has good sliding properties, i.e., a low coefficient of friction.

According to this invention, the tensioning strips can be produced with the straps in a single process. Further, in the completion of the shoe, only a single part forming the integrated instep supporting strap and tensioning strip unit needs to be provided for each side of the shoe side, for example, in a machine molding the sole or in a corresponding molded part. The tensioning strips, consequently, need no longer be attached with the shoe upper material.

These and further objects, features and advantages of the present invention will become apparent from the following detailed description when taken in connection with the accompanying drawings figures which show, for illustration purposes only, a single embodiment in accordance with the present invention.

DETAILED DESCRIPTION OF THE PREFERRED EMBODIMENT

Figure 1:
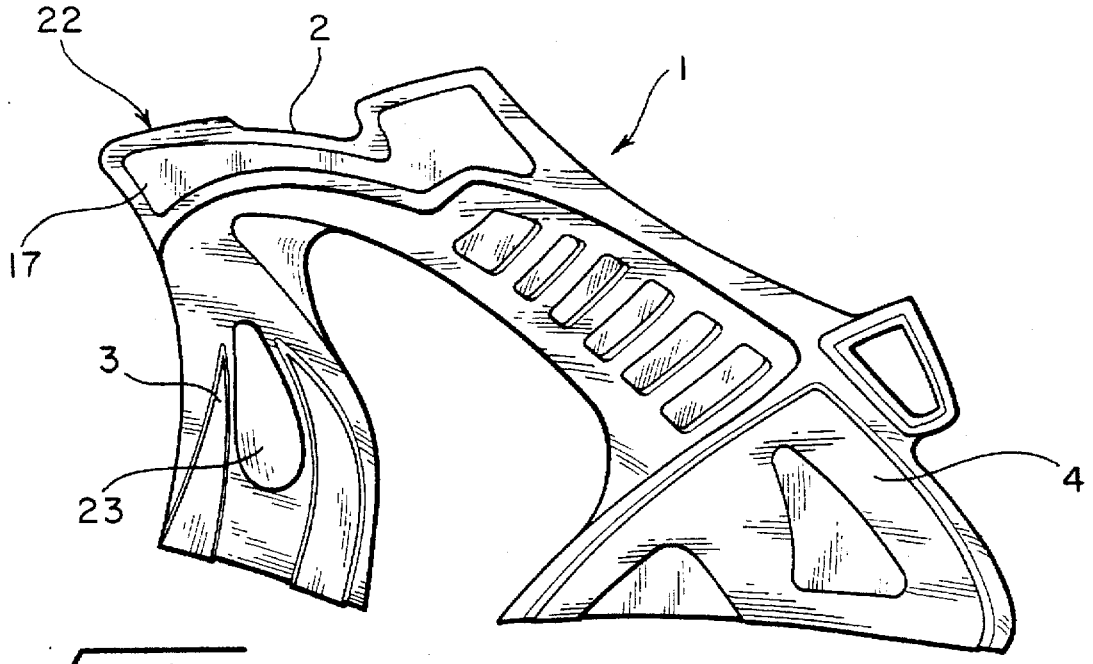
FIG. 1 is a side elevational view of the outside of a supporting strap and tensioning strip unit in accordance with a preferred embodiment of the present invention.
Figure 3:
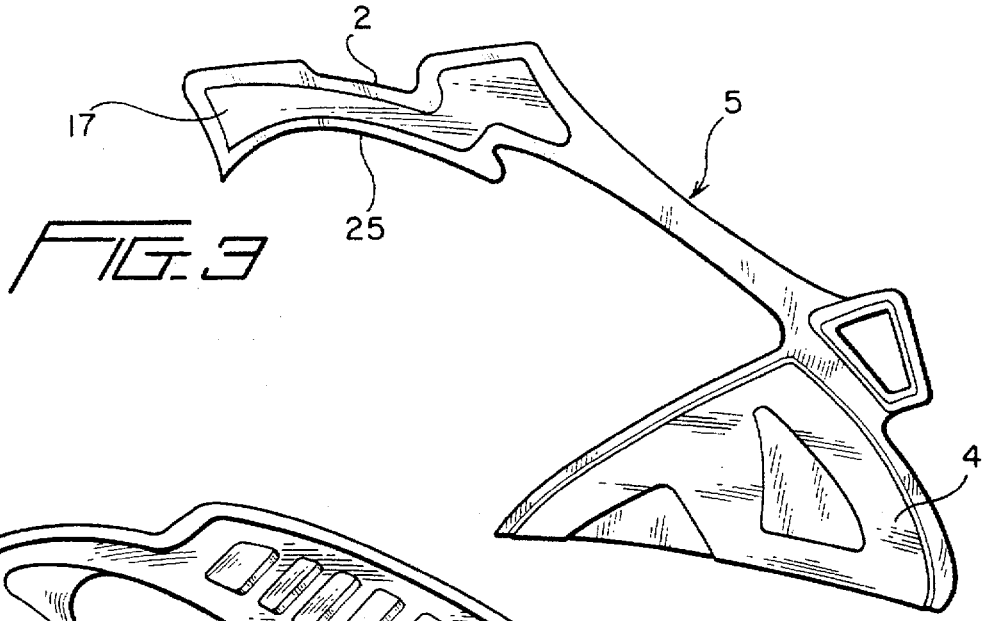
FIGS. 3 and 4 are views showing the outside of the components of which the unit represented in FIG. 1 and 2 are formed.
Figure 4:
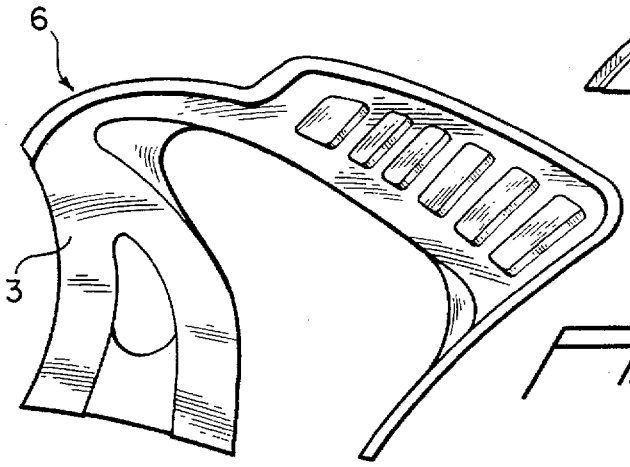

In FIG. 1, a structural unit 1 is shown which is comprised of a tensioning strip 2, a front supporting strap 3 and a rear supporting strap 4. This unit 1 is formed from two component parts 5 and 6, which are represented in FIGS. 3 and 4.

Figure 2:
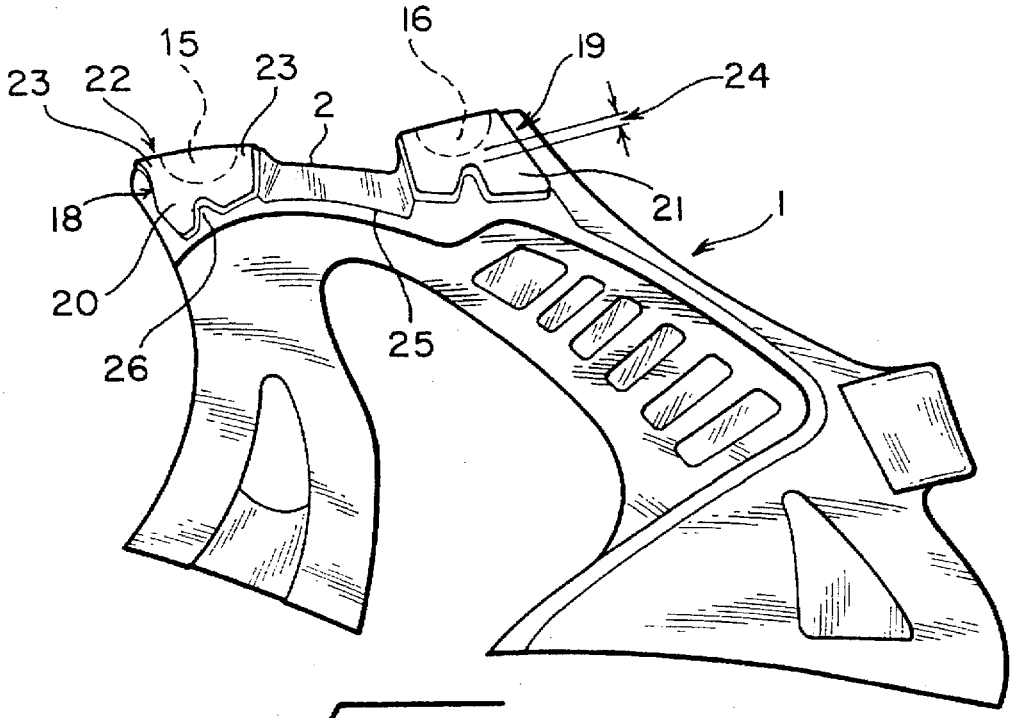
FIG. 2 is a side elevational view of the inside of the unit according to FIG. 1, but in a reversed right-to-left representation, i.e., as for unit intended for the opposite side of the shoe from that of FIG. 1.
Figure 5:
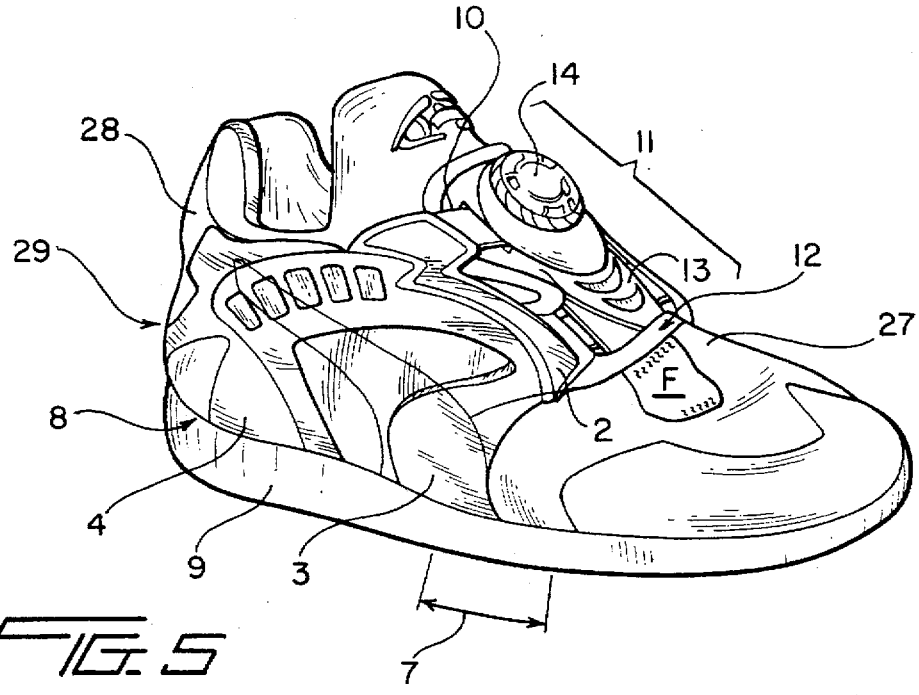
FIG. 5 is a side perspective view of a shoe with a unit according to FIG. 1 and 2.

The arrangement of unit 1 on the outer (lateral) side of a shoe can be seen from FIG. 5 (where the straps are reversed, left-to-right), relative to FIGS. 1 & 2. Front strap 3 extends upwardly from an area at or just behind the area 7 of the toe joints, where it is connected at the sole 9, and a rear strap 4 extends upwardly and forwardly from heel 8, which it encompasses on one side.

Tensioning strip 2 is coupled, by a wire-like tightening element 10, with a central closure 14 that is provided in an area 11 of instep 12 on an instep cover 13. Central closure 14 is preferably designed as a central rotary closure and it can be provided with a quick release device. Tightening element 10 runs from central closure 14 to guide elements 15 and 16 (FIG. 2) of tensioning strips 2, and in each case returns again to instep cover 13. The central rotary closure and the path of tensioning element from the closure through the guide elements can be, for example, as disclosed in the above-noted U.S. Pat. No. 5,177,882, which is hereby incorporated by reference.

Tensioning strip 2 has a raised area 17 on the outside (FIGS. 1 & 3) and has recesses 18 and 19 on the inside, in each of which a respective guide element 15, 16, in the form of semicircular guide disc having a guide groove for the tightening element 10 is attached, as is indicated in broken fines in FIG. 2. Guide elements 15, 16 are each covered by a tab 20 or 21. Tabs 20, 21 extend at least over the edge area of the periphery of guide elements 15, 16 and are cut open on the side and at the bottom, so that they can be folded away and tightening element 10 can be easily used there. The tabs 20, 21 produce an inner width between the bottom of recesses 18, 19 and their inner surface, which corresponds to at least the thickness of tightening element 10. As a result, tightening element 10 is held in its position and a good guiding of it is assured. On the upper support edge 22 of the tabs, where the guide grooves of the guide elements 15, 16 end, holes 23 are formed to allow the tightening element 10 to pass into and out of the guide grooves.

At a small distance 24 from the lower edge of recesses 18, 19 or lower edge 25 of tensioning strip 2, at least one elevated stop 26 is provided which may be, for example, tongue-shaped. Distance 24 corresponds to at least the thickness of tightening element 10. Stop 26 is provided either on the bottom of recesses 18, 19 or on the inside of tabs 20, 21. Stops 26 are used so that the tightening element 10 is properly guided and does not fall out of the guide groove even in an unstressed state.

Recesses 18, 19, guide elements 15, 16 and holes 23 as well as tabs 20, 21 are placed so that production of tensioning strip 2, together with rear support strap 4, can take place in a single, two-piece mold. In particular, the mold can include a sliding core that can be inserted from below, for example, from lower edge 25 and removed downward.

The outside surface of tabs 20, 21 preferably runs in a common plane with the inside of tensioning strip 2 to avoid pressure points on the instep of the wearer of the shoe.

Unit 1 can consist of a single molded part or of two parts, for example, of represented parts 5 and 6 according to FIG. 3. Tensioning strip 2 has a greater stiffness than supporting straps 3, 4. For this purpose, the thickness of tensioning strip 2 and/or the properties of the materials used can be selected so that this greater stiffness occurs. Further, the material of tensioning strip 2 is highly resistant to abrasion at least in the area of guide elements 15, 16, and it has good sliding properties for tightening element 10. Preferably, tensioning strip 2 is about 1.5 to 3 times as thick as the thickness of the supporting straps 3, 4. The hardness of tensioning strips 2 is about 60 to 70 Shore D. The hardness of straps 3, 4 can be about 45 to 55 Shore D. The hardness of guide elements 15, 16 is preferably more than 70 shore D. Rear strap 4 can also consist of harder material, for example, of the same material, as tensioning strip 2. The material of front strap 3, optionally also that of rear strap 4, advantageously has rubber-elastic properties. The tensioning strips 2, supporting straps 3, 4 and guide elements 15, 16, preferably, are formed of a compact plastic material, such as a polyamide, polyimide, polyethylene, polyurethane or the like.

The upper 27 of the shoe shown in FIG. 5, which apart from its manner of closure is a typical athletic shoe, can be made using conventional fabric and/or leather technology. Alternatively, it can be formed as a so-called sock-like inner shoe or tongue and lateral upper, of volume-compressible material, especially of closed-pore plastic foam, such as chlorinated rubber or the like, which at least on the outside, preferably also on the inside, has a layer of fabric F. In particular, in the use of such a shoe upper 27, it is advisable to provide an elastically expandable, especially rubber-elastic heel strap 28, connecting from one rear strap 4 to the other on the opposite side of the upper. This heel strap 28, as FIG. 5 shows, runs above heel bone 29. As a result, a firm fit of the foot in the shoe can be achieved with a shoe upper which does not have a stiff heel counter.

To achieve a good release of heat from the foot to the outside of the shoe, even with an upper 27 formed of a closed-pore foam material, the upper 27 is provided with fine bore holes, especially with micropores going through from one side to the other, at least in the area where the foam material is covered by the instep cover 13, tensioning strips 2 and supporting straps 3, 4. These micropores are made, for example, by a laser beam process. The micropore density is, for example, about 50 to 200 micropores/$cm^2$.

Even though only two straps 3, 4 are shown as being provided on each side of the shoe in the drawings, this invention does not exclude the use of more than two straps per side of the shoe upper.

The guide element or elements on instep shield 13 are arranged in a known way so that the guiding of tensioning element 10 takes place without crossing the tongue or instep cover or at most with one such crossing near the bottom of the throat area.

If the above-described shoe is to be used as a rehabilitation shoe with a high top upper, additional supporting elements can, preferably, be provided in the ankle area and special sliding areas can be provided in the outsole area which make possible an especially good hold of the foot in the shoe and as unobstructed as possible a sliding movement of such a rehabilitation shoe on the corresponding floor surface. For this purpose, reference can be made to U.S. Pat. Nos. 4,726,126 and 4,727,660, respectively, which patents are hereby incorporated by reference.

While only a single embodiment in accordance with the present invention has been shown and described, it is understood that the invention is not limited thereto, and is susceptible to numerous changes and modifications as are known to those skilled in the art. Therefore, this invention is not intended to be limited to the details shown and described herein, and includes all such changes and modifications as are encompassed by the scope of the appended claims.

I claim:

1. Shoe with an upper formed at least in part of an elastically flexible material, a sole to which the upper is attached, an instep cover hinged to the upper at a lower end thereof, a central closure attached to the instep cover in an instep area, a wire-like tightening element coupled with the central closure and running down one side of a throat area of the upper and back up an opposite side thereof to the central closure, at each side of the upper the tightening element running back and forth between guide elements on a tensioning strip and guide elements on the instep cover, each tensioning strip being formed as part of a structural unit for each side of the shoe, said structural unit being a separate and independent part with respect to said instep cover having at least two supporting straps which run over the upper to at least an edge area of the sole as permanent parts thereof with the tensioning strip, a first of the supporting straps being directed toward an area at least as far rearward as the metatarsophalangeal joints and a second of the supporting straps extending rearwardly to a heel part of the shoe and at least partially encompasses the heel at least in the edge area of the sole; wherein the tensioning strips have a greater stiffness than the supporting straps; and wherein the tensioning strips, at least in an area at which the guide elements are provided thereon, are made of a material that is abrasion-resistant, hard and of a low coefficient of friction.

2. Shoe according to claim 1, wherein the greater stiffness of the tensioning strips relative to the supporting straps is due to the tensioning strips being formed of at least one of a greater thickness and a material having greater stiffness properties than the supporting strips.

3. Show according to claim 2, wherein the thickness of tensioning strips is about 1.5 to 3 times greater than that of the straps.

4. Shoe according to claim 3, wherein the material of the tensioning strips has a hardness of about 60 to 70 Shore D and the straps have a hardness of about 45 to 55 Shore D.

5. Shoe according to claim 1, wherein the unit of the tensioning strip and supporting straps are formed of an integrally molded one-piece construction.

6. Shoe according to claim 5, wherein the material of the tensioning strips has a hardness of about 60 to 70 Shore D and the straps have a hardness of about 45 to 55 Shore D.

7. Shoe according to claim 5, wherein the thickness of tensioning strips is about 1.5 to 3 times greater than that of the straps.

8. Shoe according to claim 1, wherein a heel strap runs, at a location above a wearer's heel bone, from the second supporting strap of the unit for one side of the shoe to the second supporting strap of the unit for the opposite side of the shoe.

9. Shoe according to claim 8, wherein the heel strap is formed of a rubber-elastic material.

10. Shoe according to claim 1, wherein at least in areas in which the instep cover, tensioning strips and straps cover the upper, the upper is formed of a volume-compressible foam with a fabric layer at least on an outer side thereof.

11. Shoe according to claim 10, wherein the foam is provided with micropores going through one side to another.

12. Shoe according to claim 1, wherein the central closure is a central rotary closure.

13. Shoe according to claim 12, wherein the central rotary closure has a quick release mechanism.

14. Shoe with an upper formed at least in part of an elastically flexible material, a sole to which the upper is attached, an instep cover hinged to the upper at a lower end thereof, a central closure attached to the instep cover in an instep area, a wire-like tightening element coupled with the central closure and running down one side of a throat area of the upper and back up an opposite side thereof to the central closure, at each side of the upper the tightening element running back and forth between guide elements on a tensioning strip and guide elements on the instep cover, each tensioning strip being formed as part of a structural unit for each side of the shoe, said structural unit having at least two supporting straps which run over the upper to at least an edge area of the sole as permanent parts thereof with the tensioning strip, a first of the supporting straps being directed toward an area at least as far rearward as the metatarsophalangeal joints and a second of the supporting straps extending rearwardly toward a heel part of the shoe; wherein the tensioning strips have a greater stiffness than the supporting straps; and wherein the tensioning strips, at least in an area at which the guide elements are provided thereon, are made of a material that is abrasion-resistant, hard and of a low coefficient of friction; wherein the guide elements on each of the tensioning strips are recessed in portions of the tensioning strips on an inner side thereof; wherein at least a recessed edge area along the periphery of each guide element is covered by a tab portion of the tensioning strip, said tab portion providing a guide space relative to the respective guide element of a width which corresponds to at least the thickness of the tightening element and producing proper guidance of the tightening element over the respective guide element; and wherein an edge of each tensioning strip is provided with holes at opposite ends of said guide space which lead to and from the respective guide element for the tightening element.

15. Shoe according to claim 14, wherein the recessed guide elements, tabs and holes are arranged in essentially the same direction as a means for enabling the tensioning strip to have been produced in a two piece mold with a movable core that can be inserted and removed from a lower edge of the tensioning strips in said direction.

16. Shoe according to claim 14, wherein at least one stop in the form of an elevation is provided at a distance, from a peripheral surface of the respective guide element which faces a lower edge of the tensioning strip, that at least corresponds to the thickness of the tightening element yet is close enough to insure proper guidance thereof.

17. Shoe with an upper formed at least in part of an elastically flexible material, a sole to which the upper is attached, an instep cover hinged to the upper at a lower end thereof, a central closure attached to the instep cover in an instep area, a wire-like tightening element coupled with the central closure and running down one side of a throat area of the upper and back up an opposite side thereof to the central closure, at each side of the upper the tightening element running back and forth between guide elements on a tensioning strip and guide elements on the instep cover, each tensioning strip being formed as part of a structural unit for each side of the shoe, said structural unit having at least two supporting straps which run over the upper to at least an edge area of the sole as permanent parts thereof with the tensioning strip, a first of the supporting straps being directed toward an area at least as far rearward as the metatarsophalangeal joints and a second of the supporting straps extending rearwardly to a heel part of the shoe and at least partially encompasses the heel at least in the edge area of the sole; wherein the tensioning strips have a greater stiffness than the supporting straps; and wherein the tensioning strips, at least in an area at which the guide elements are provided thereon, are made of a material that is abrasion-resistant, hard and of a low coefficient of friction.

18. Shoe according to claim 17, wherein a heel strap runs at a location above a wearer's heel bone, from the second supporting strap of the unit for one side of the shoe to the second supporting of the unit for the opposite side of the shoe.

19. Shoe according to claim 18, wherein the heel strap is formed of a rubber-elastic material.

* * * * *